US006793200B2

(12) United States Patent
Bystrom

(10) Patent No.: US 6,793,200 B2
(45) Date of Patent: Sep. 21, 2004

(54) NAIL PULLING DEVICE

(76) Inventor: Michael J. Bystrom, 7445 Cornell St., St. Louis, MO (US) 63130

( * ) Notice: Subject to any disclaimer, the term of this patent is extended or adjusted under 35 U.S.C. 154(b) by 0 days.

(21) Appl. No.: 09/952,255

(22) Filed: Sep. 14, 2001

(65) Prior Publication Data

US 2003/0052312 A1 Mar. 20, 2003

(51) Int. Cl.[7] ..... B66F 15/00
(52) U.S. Cl. ..... 254/26 R
(58) Field of Search ..... 254/26 R, 25; 81/20

(56) References Cited

U.S. PATENT DOCUMENTS 1,042,177 A * 10/1912 Vredenburg ..... 254/26 R
2,527,738 A * 10/1950 Kirk ..... 254/26 R
2001/0025949 A1 * 10/2001 Fagan ..... 254/25

* cited by examiner

*Primary Examiner*—Robert C. Watson
(74) *Attorney, Agent, or Firm*—Peter B. Scull; Dahl & Osterloth, LLP

(57) ABSTRACT

A nail removing hand tool has been developed. This tool comprises a nail removal means containing continuously curved head portion attached to a handle. The handle is attached to the head portion in such a manner that the continuous curved nature of the upper surface of the head is unimpaired. In one embodiment of the tool, a striker head is incorporated in the structure to provide a device which can perform both nail insertion and nail removal functions.

3 Claims, 1 Drawing Sheet

NAIL PULLING DEVICE

FIELD OF THE INVENTION

This invention relates generally to the field of hand tools and more particularly to a nail pulling device, either as a stand alone tool or as an integral part of another hand tool, which is capable of removing nails and like non-threaded fasteners from materials, such as wood with a simple rotating action and without impairing the surface into which the fastener is seated.

BACKGROUND OF THE INVENTION

The intelligent design and use of tools may in part measure the technological advancement of a culture. Throughout human history, efforts to make tools more efficient have continued. These efforts persist to this day, and have not been focussed merely on expensive, complicated tools. For example, dust pans were greatly improved in the twentieth century when a rubber flange was attached to the blade of the pan, to both increase the efficiency of the sweeping process, and to possibly minimize scratches to the surface being swept.

In one form or another, hammers have been used for at least hundreds, if not thousands of years. Traditionally, hammers are associated with nails. This association has even been memorialized in song lyrics, such as, "I'd rather be a hammer than a nail . . . " Hammers perform two functions with nails; namely, they insert them into materials, and remove them from materials.

Both functions require a combination of strength and skill. The hammering of nails into a surface is the obvious function of a hammer. However, the nail removal function may be of equal, or even greater importance.

Human error seems to be one of the few constants of the human experience; however nail removal is not only associated with human error. For example, a nail may be used to create a starter, or pilot hole, in a surface, and then need to be removed. Additionally, nails could need to be removed from a board so that the board may be reused. In fact, in certain cases, nails are removed from boards so that both the nails and the board may be reused.

Both the insertion, and the removal, of a nail may damage the surface in question. While in some applications, such as constructing a log cabin from unfinished wood, the condition of the surface of the material being fastened together is relatively unimportant. However, when a finished material, such as finished wood, is being used, surface conditions may be very important. Accordingly, the avoidance of damage to a finished surface during the nail insertion/nail removal process may be extremely important.

Traditionally, a claw is attached to the trailing edge of a hammerhead to enable the removal of nails thereby. This removal requires inserting the claw of the hammer between the surface into which the nail is inserted, and the head of the nail. As is well known, force is applied to the handle of the hammer that is rotationally transferred to the claw via a fulcrum portion of the hammer which thereafter pulls the nail out of the surface in question.

However no tool, and no hammer appears to have been designed to facilitate such removal, or to minimize the damage to a surface caused by pressure of the fulcrum into the surface while the nail is being removed. Applicant believes that such a need exists and it is towards the provision of a scar-free nail puller that the present invention is directed.

BRIEF DESCRIPTION OF THE INVENTION

In brief, the present invention comprises a continuously curved body member attachable to a handle in such a manner so that the handle does not interfere with the action of the continuously curved surface, as will be herein described. The continuously curved surface is sufficiently rigid to allow the necessary force transference from the handle without denting the surface. The surface has a first edge and a second edge, a face, and a back.

The handle is substantially rigidly attached to the back of the surface. If desired, a nail-striking surface may be provided adjacent one edge of the curved surface. Nail removal means may be incorporated within the curved surface, proximate the second edge of the curved surface. Most commonly, these nail removal means will strongly resemble those nail removal means well known in the art that are commonly found in currently available hammers.

The operation of the present invention is substantially identical to that of a typical hammer when used to remove a nail from a surface. However, because the head portion of the present invention comprises a continuous curved surface, rather than the customary prior art fulcrumed configuration, damage to the surface from which the nail is removed, is eliminated.

Accordingly a prime object of the present invention is to provide a hand tool adapted for the ready removal of pointed non-threaded fasteners having a head from a surface, while substantially eliminating the potential damage to that surface.

Another object of the present invention is to provide a hand tool adapted for both the insertion and removal of pointed non-threaded fasteners from a surface while minimizing the potential damage to that surface during the removal process.

These and still further objects as shall hereinafter appear are fulfilled by the present invention in a remarkably unexpected manner as can readily be discerned from the following detailed description of an exemplary embodiment of the present invention particularly when read in conjunction with the accompanying drawings in which like parts bear like reference throughout the several views.

DETAILED DESCRIPTION OF THE PREFERRED EMBODIMENT

Figure 1:
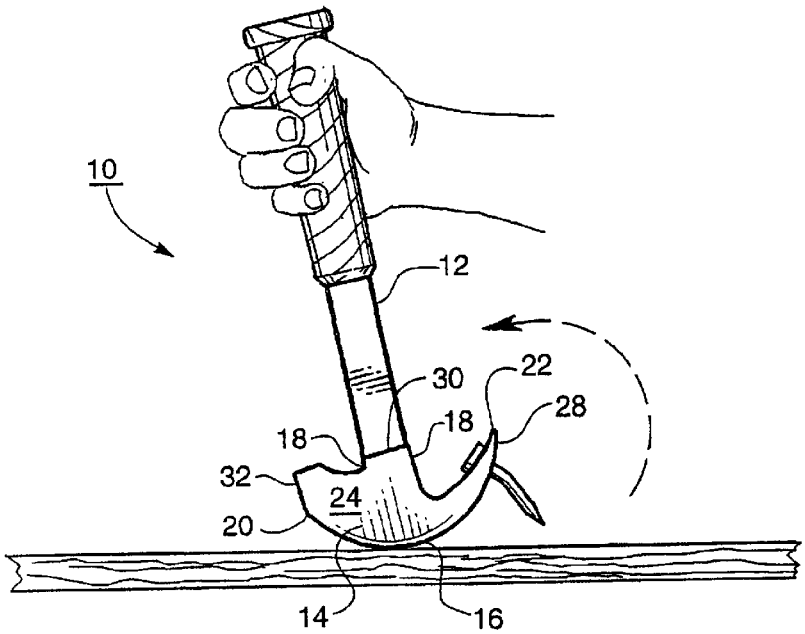
FIG. 1 is a side elevation showing a device embodying the present invention in the act of pulling a nail.
Figure 2:
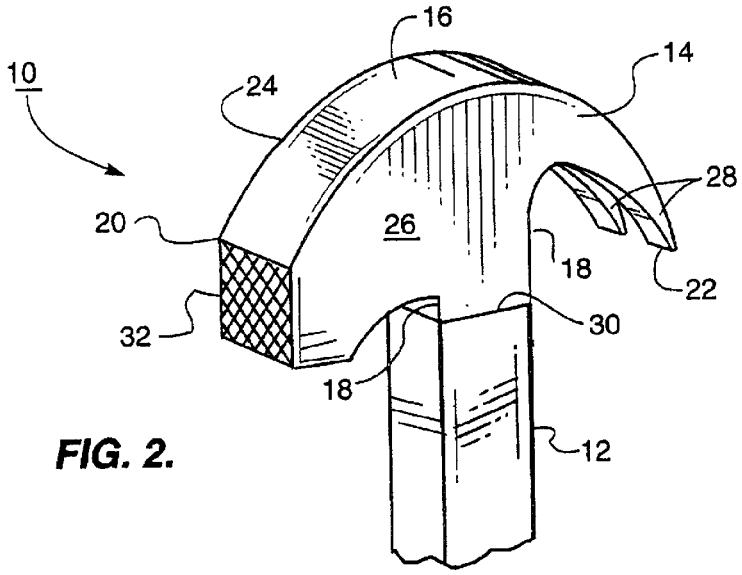
FIG. 2 is an isometric view, partially broken away of the device embodying the present invention.

As shown in FIGS. 1 and 2, the present invention, referred to throughout by the general reference 10, comprises a handle portion 12, and a continuously curved head portion 14 operatively attached thereto. In the preferred embodiment, head portion 14 comprises a first continuously curved surface 16, a handle receiving surface 18, a first end 20, a second end 22, and sides 24. 26. First surface 16 is both uniformly and continuously curved, and smooth for reasons to be hereinafter described Second end 22 of curved surface 16 is provided with bifurcated nail removal means 28. Removal means 28 may be shaped in any convenient manner to allow their ready insertion beneath the head of a headed pointed non-threaded fastener, consistent with maintaining the integrity of smooth continuously curved surface 16. The configuration shown in FIG. 2 is the best means presently known to applicant, but any mechanically equivalent configuration can be used.

Handle 12 is secured to head portion 14 by means of operatively attaching handle 12 to a suitable socket 30 located in handle receiving surface 18. This attachment may be accomplished by any suitable means known to one skilled in the art so long as no portion of either handle 12, or receptacle 30, disrupts the smooth continuous curve of surface 16.

To use device 10 to remove a headed pointed fastener such as a nail from a surface, device 10 is positioned so that continuously curved surface 16 is in contact with the nail containing surface, and removal means 28 is positioned about the nail and intermediate the surface containing the nail and the head of the nail which is to be removed. To remove of the nail, handle 12 is rotated towards first end 20 on the continuous surface 16. The motion described above causes end 20 to move towards the nail-containing surface, while end 22 and removal means 26 rotates away from the nail-containing surface and extracts the nail.

As is further well known in the art, this rotation causes removal means 28 to transfer a removing force to the nail with which means 28 is engaged. Presuming that this nail retains its structural integrity, the nail will be removed from the nail-containing surface.

A number of modifications may also be made to the device 10. As shown best in FIG. 2, a hammer like striker surface 32 is provided at end 20 of device 10 and is disposed to extend away from surface 16 and not impair the continuously thereof.

While one version of the invention has been herein illustrated and described, it is understood that such modifications, alterations and adaptation as may be deduced herefrom by one having ordinary skill in the art are intended within the spirit of this disclosure which is limited only by the scope of the claims attached hereto. It is further submitted that the optimal dimensional relationships for the parts of the invention, include variations in size, materials, shape, form, function and manner of operation, assembly and use, are deemed readily apparent and obvious to one of ordinary skill in the art.

The following is claimed:

1. A nail removal device comprising a head portion and a handle portion, said head portion comprising a continuously curved surface defined by a substantially constant radius of curvature and by an arc of about 180 degrees, said continuously curved surface having a first end, and a second end defining respective ends of said arc of about 180 degrees, and sides, said handle portion being fixedly attached to said head portion, said head portion having a nail striking surface defined at the first end of the continuously curved surface and nail removal means defined in said second end of said continuously curved surface, the arc of the continuously curved surface being defined as running from the nail striking surface to and including the end of the nail removal means.

2. A nail removal device comprising a head portion and a handle portion, said head portion comprises a continuously curved surface defined by a substantially constant radius of curvature and by an arc of about 180 degrees, said continuously curved surface having a first end, and a second end defining respective ends of said arc of about 180 degrees, and sides, said handle portion being fixedly attached to said head portion, said head portion having nail removal means defined in said second end of said continuously curved surface, and an impact surface defined in said first end of said surface, the arc of the continuously curved surface being defined as running from the impact surface to and including the end of the nail removal means.

3. A device having a nail remover and a hammer formed integrally therein, said device comprising:

a head portion;

and a handle portion, wherein said head portion comprises a surface having a nail striking portion and a nail removing portion, and wherein said head portion has a handle accepting portion integrally associated therewith wherein said handle accepting portion is operatively connected to said handle, said surface of said head portion comprising a smooth continuous curve defined by a substantially constant radius of curvature and by an arc of about 180 degrees, said surface having said nail striking portion defined at an end of said surface remote by said arc of about 180 degrees from the end of said nail removing portion of said surface.

* * * * *